United States Patent [19]

Young et al.

[11] Patent Number: 4,807,756

[45] Date of Patent: Feb. 28, 1989

[54] PRODUCE CARTON STRENGTHENING BRACKET

[76] Inventors: Thomas R. Young, 1535 East Orangewood, #118, Anaheim, Calif. 92806; David A. Aure, Rte. 1, Box 112, Earlimart, Calif. 93219

[21] Appl. No.: 30,406

[22] Filed: Apr. 1, 1987

Related U.S. Application Data

[63] Continuation-in-part of Ser. No. 857,735, Apr. 29, 1986, abandoned.

[51] Int. Cl.[4] ..... B65D 21/02; B65D 5/44

[52] U.S. Cl. ..... 206/509; 217/69; 229/198; 229/199; 229/919; 206/821

[58] Field of Search ..... 206/509, 821; 229/23 R, 229/49, 198, 199, 915, 916, 917, 918, 919; 217/69; 220/DIG. 14

[56] References Cited

U.S. PATENT DOCUMENTS

| | | | |
|---|---|---|---|
| 1,951,972 | 3/1934 | Fraser . | |
| 2,191,291 | 2/1940 | Smith | 229/198 |
| 2,235,709 | 3/1941 | Hearn et al. . | |
| 2,268,236 | 12/1941 | Baird | 229/199 |
| 2,662,620 | 12/1953 | Vojta | 217/69 |
| 2,687,157 | 8/1954 | Cowan | 220/DIG. 14 |
| 2,868,430 | 1/1959 | Hamilton . | |
| 2,896,835 | 7/1959 | Burkhardt et al. . | |
| 2,914,235 | 11/1959 | Jones . | |
| 2,987,198 | 6/1961 | Crane . | |
| 3,031,125 | 4/1962 | Felton | 229/199 |
| 3,118,563 | 1/1964 | Suchodolski . | |
| 3,211,328 | 10/1965 | Davis . | |
| 3,226,008 | 12/1965 | Chiorri | 229/49 |
| 3,373,921 | 3/1968 | Crane . | |
| 3,463,378 | 8/1969 | Van Daalen . | |
| 3,487,991 | 1/1970 | Stern . | |
| 3,544,021 | 12/1970 | Wilson | 229/49 |
| 3,606,949 | 9/1971 | Joyce . | |
| 3,659,774 | 5/1972 | Mielke . | |
| 3,820,706 | 6/1974 | Gibson et al. . | |
| 3,899,121 | 8/1975 | Herbetko . | |
| 3,915,372 | 10/1975 | Crane . | |
| 3,935,990 | 2/1976 | Crane . | |
| 3,935,991 | 2/1976 | Crane . | |
| 4,039,119 | 8/1977 | Crane . | |
| 4,039,121 | 8/1977 | Crane . | |
| 4,068,794 | 1/1978 | Lawrence . | |
| 4,126,265 | 11/1986 | Holmes . | |
| 4,266,714 | 5/1981 | Crane . | |
| 4,373,659 | 2/1983 | Cornell | 229/915 |
| 4,482,074 | 11/1984 | Lalley | 229/23 R |

FOREIGN PATENT DOCUMENTS

| | | | |
|---|---|---|---|
| 738997 | 3/1970 | Belgium | 229/918 |
| 71048 | 10/1959 | France | 229/49 |
| 515271 | 4/1957 | Italy | 229/198 |
| 667808 | 9/1964 | Italy | 229/199 |

*Primary Examiner*—George E. Lowrance
*Attorney, Agent, or Firm*—Stetina and Brunda

[57] ABSTRACT

A bracket for strengthening a carton which has a bottom wall, side walls, an end flap and interior flaps, for holding the flaps and for supporting additional cartons in a stack of cartons, comprising a flange parallel to the bottom wall and a pair of members perpendicular to the bottom wall joined by the flange and extending substantially throughout the height of the carton to resist the bending and twisting of the carton. The members are each positioned to substantially enclose one of the corners of the carton and to abut an edge, perpendicular to the bottom wall, of one of the side walls and the end flap. Tabs are provided to align a stack and to lock the carton top closed.

18 Claims, 6 Drawing Sheets

Fig. 5
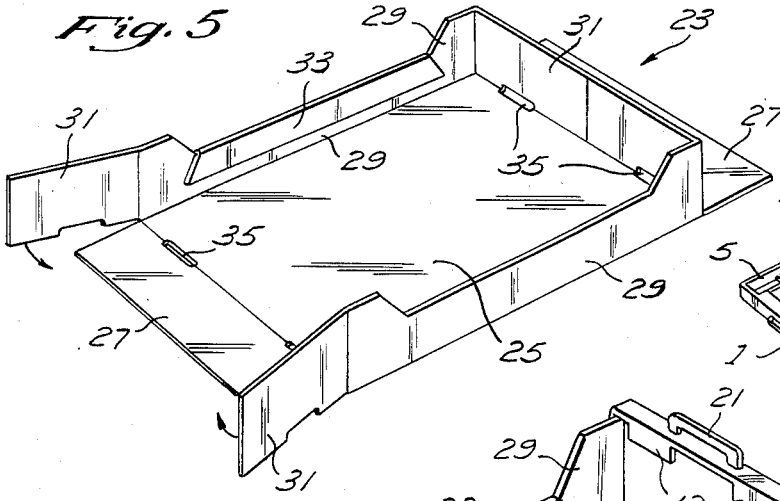
Fig. 6
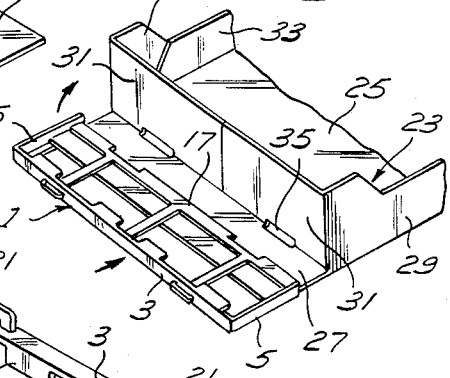
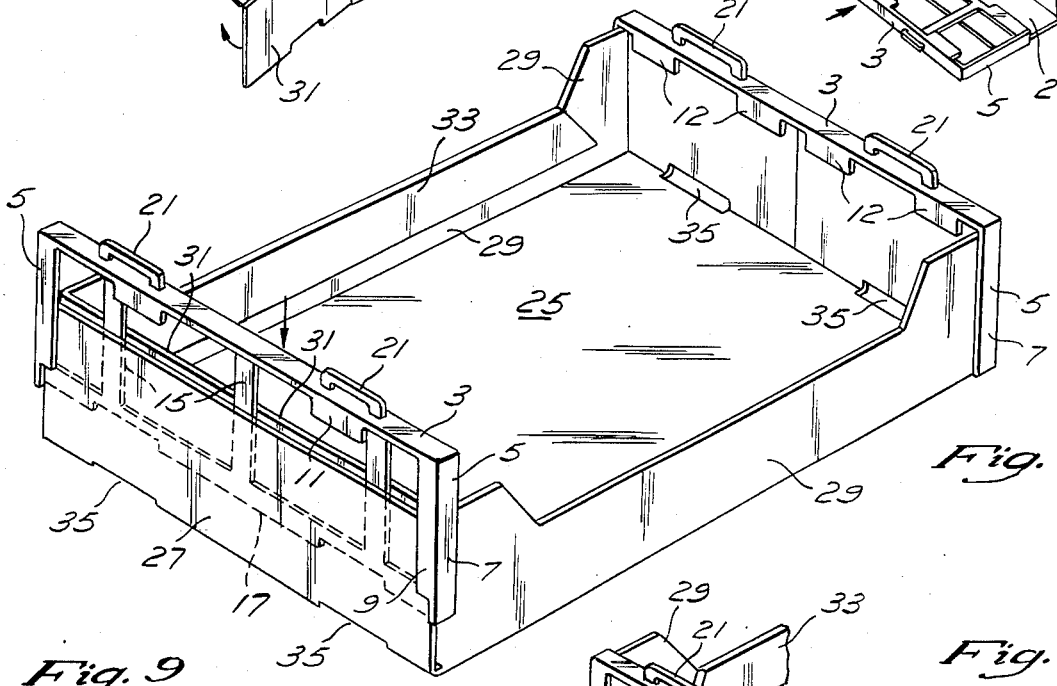
Fig. 7
Fig. 8
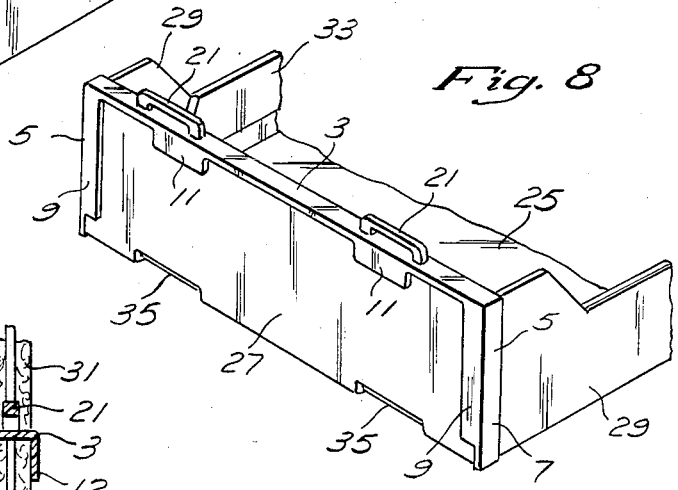
Fig. 9
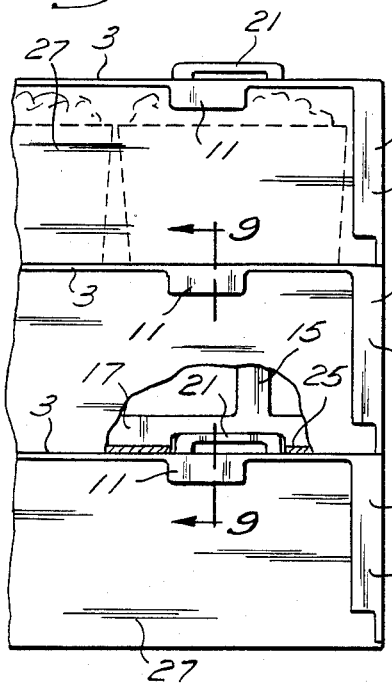
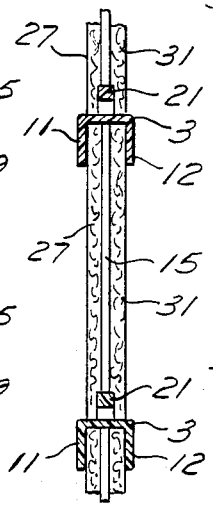
Fig. 10

Fig. 11
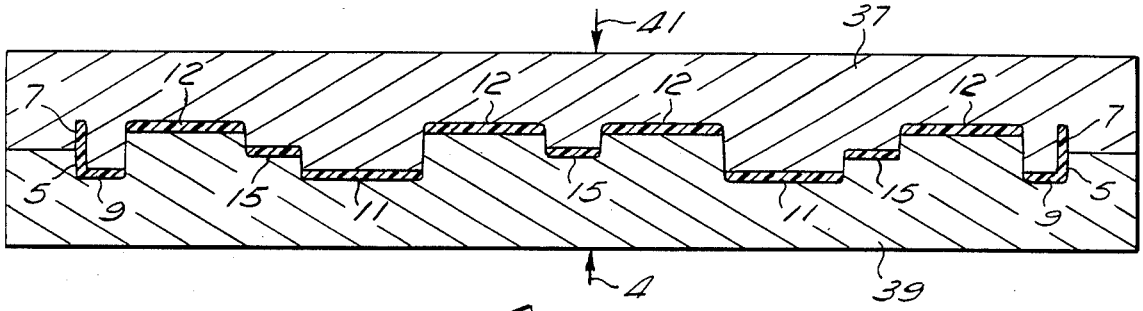
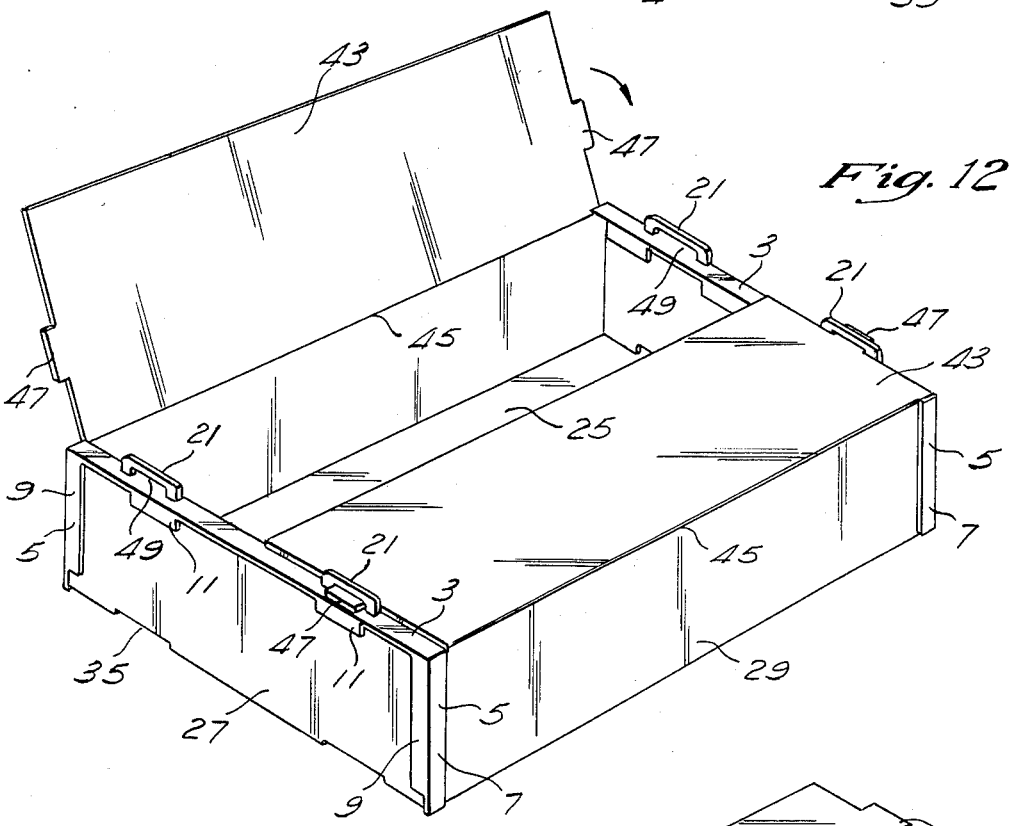
Fig. 12
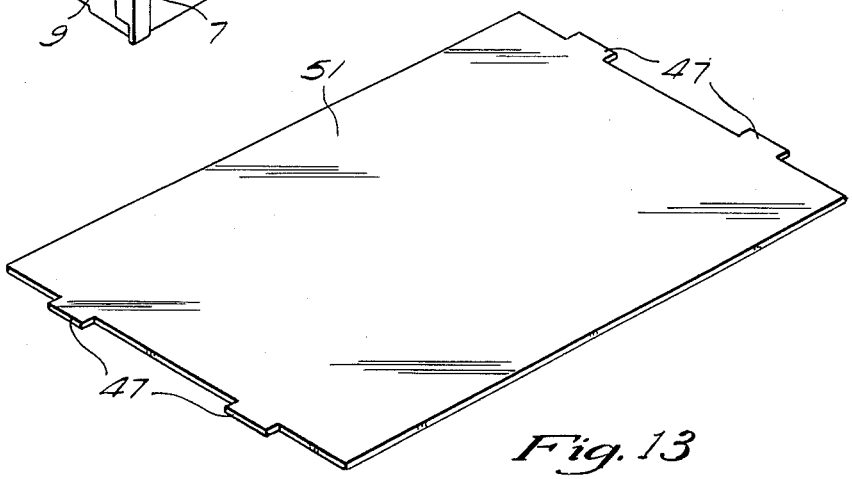
Fig. 13

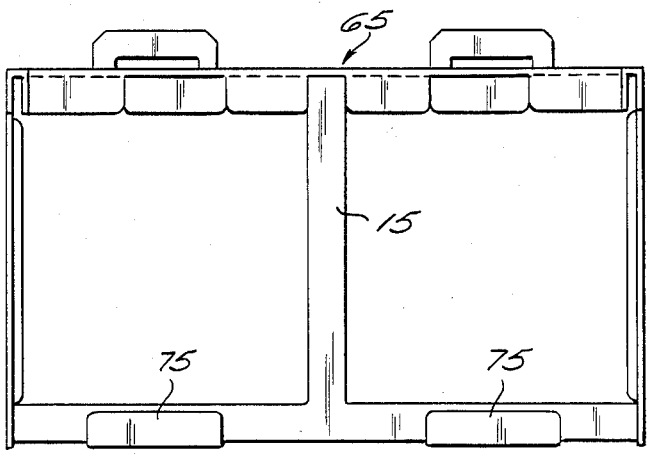
Fig. 20
Fig. 21
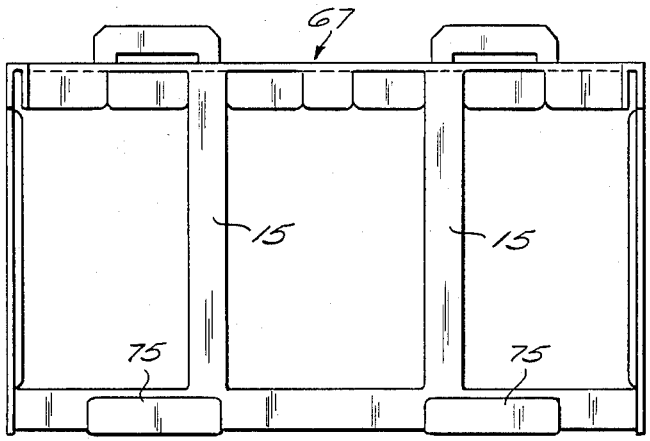
Fig. 22
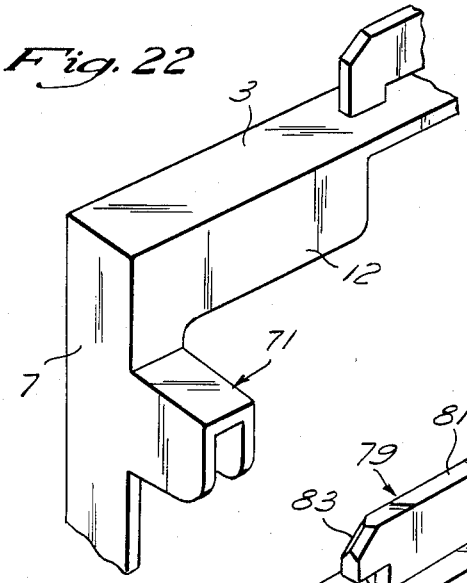
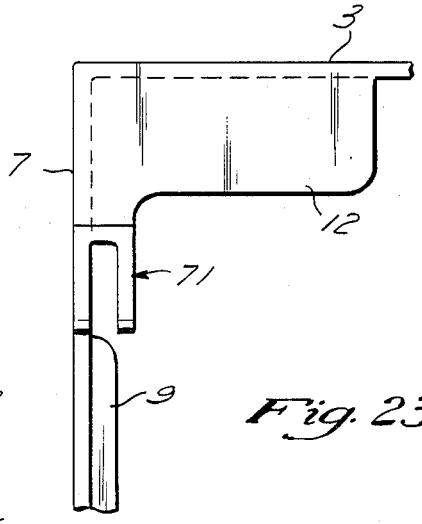
Fig. 23
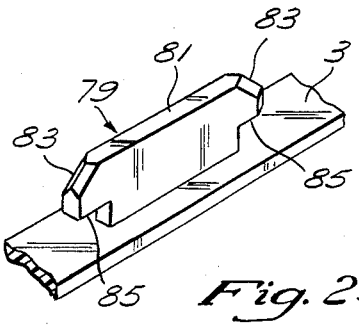
Fig. 24

PRODUCE CARTON STRENGTHENING BRACKET

RELATED APPLICATIONS

This is a continuation-in-part of parent application, Ser. No. 857,735, filed Apr. 29, 1986, now abandoned inventors Thomas R. Young and David A. Aure, and entitled, PRODUCE CARTON STRENGTHENING BRACKET.

BACKGROUND OF THE INVENTION

This invention relates to cartons which are subjected to loads from stacking. An example is for transporting produce, e.g., strawberries and grapes, in stacked loads.

The cost of transporting produce from the fields to the ultimate consumer is partially determined by the gross weight of what is being shipped. Since it costs just as much per pound to transport the cartons in which the produce is shipped as the produce itself, it is desirable that the cartons weigh as little as possible. For this reason, and due to corrugated paper's strength and low cost, packaging produce in corrugated cartons has become the preferred mode of transporting fresh produce.

Since the cost of transporting the produce to market is also partially determined by the amount of floor space taken up by the produce, it is necessary that these cartons be placed in relatively tall stacks. This means that the cartons at the bottom of the stacks must be able to support the weight of virtually the entire stack of cartons. Furthermore, when the vehicle transporting the produce turns or sways, the inertia of the cartons causes the stacks to twist and sway. Since the stacks are held stationary only at the bottom, the twisting and swaying of the stacks causes a disproportionately large amount torque to be applied to the walls of lower cartons.

The produce being transported is often quite wet and the moisture from the produce has a tendency to gradually saturate the corrugated cartons. When this occurs, the load and torque-bearing capacity of the corrugated cartons greatly diminishes. In this state, the weakened upper corners of the cartons have a tendency to distend outward, thereby allowing the weight of the cartons stacked above to force the carton formerly supported by the corners to slide into the lower carton and damage the produce contained therein. The twisting of the stacks may also cause the relatively weak end of one of the wetted cartons to twist and misshapen, allowing the weight of the cartons stacked above to crush the produce in the carton. In the worst case, the saturated corner of one of the lower cartons could so weaken that it completely buckles, thereby removing one of the corner supports from the stack and potentially causing the entire stack to tumble over.

In light of the problems involved in transporting wet produce in corrugated cartons, it is desirable that the cartons be reinforced in some manner. It is important, however, that the means utilized to reinforce the corrugated cartons not add significantly to the weight, bulk, or cost of the cartons.

Since it is envisioned that large quantities of the reinforced cartons will need to be assembled, it is important that the carton design lend itself to simple and inexpensive mass production techniques. The corrugated portion of the carton should preferably be as simple as possible so that the the number of cutting operations necessary to make it is minimized. Likewise, the reinforcing means itself should be relatively inexpensive to manufacture. It is also desirable, in order to minimize inventory problems, that the reinforced corrugated design incorporate a minimum number of parts, and that these parts be as light and as compact as possible for easy handling and storage.

The process of assembling the reinforced corrugated cartons ought to be as simple as possible. Every step in the process should be simple enough that it can be performed by machine. Finally, although the corrugated portion of the reinforced boxes typically will be destroyed by the moisture from the produce, it is desirable that the reinforcing means be recycled, in order that material costs can be minimized.

Necessarily, the recycling process will only be cost effective if the used boxes can be simply and easily disassembled. Preferably, the disassembling process should be able to be performed without tools of any kind and without the necessity of undue care being taken in order ensure that the reinforcing means is not damaged. The reinforcing means should also be relatively light and compact so that the cost involved in transporting the reinforcing means from the market to the carton assembly location is not prohibitive.

What is needed is a simple and effective means of reinforcing corrugated produce cartons so that they, even when wet, will be able to support the weight of the cartons stacked above them, and bear the torque applied upon them due to the twisting and swaying of the stacked cartons.

SUMMARY OF THE INVENTION

This invention provides a bracket for strengthening a carton, for holding its flaps assembled, and for supporting additional cartons in a stack. Typically, the carton has a bottom wall, side walls, an end flap and interior flaps. The bracket includes a flange parallel to the bottom wall and a pair of members perpendicular to the bottom wall joined by the flange and extending substantially throughout the height of the carton to resist the bending and twisting of the carton. The members are each positioned to substantially enclose one of the corners of the carton and to abut an edge, perpendicular to the bottom wall, of one of the side walls and the end flap.

Preferably, the bracket will include a series of depending flap retainers perpendicular to the bottom wall and positioned along the edge of the flange for engaging the carton's flaps. Advantageously, the bracket will also include an internal member between the end flap and the interior flaps, and depending from the flange a significant portion of the height of the end flap, and a connector at the base of the internal member which joins the members. Furthermore, it is preferable that the bracket incorporate means for aligning the cartons in a stack.

In one embodiment, the bracket is provided with a torque-resisting extension which abuts the interior and exterior surfaces of a side wall and which extends thereover.

Another aspect of the invention is a method of inserting a flap holder into a carton which has a bottom wall, side walls, an end flap and interior flaps. The method comprises the steps of initially partially inserting the holder over the end flap before the end flap is adjacent the interior flaps, moving the holder and the end flap to a position essentially perpendicular to the bottom wall and adjacent the interior flaps, and moving the holder relative to the end flaps and the interior flaps in a direction essentially perpendicular to the bottom wall so that the holder holds the end flap and the interior flaps adjacent one another.

Another aspect of the invention is a method of removing a flap holder from such a carton where the flap holder is initially positioned between the end flap and the interior flaps and abuts the exterior of the end flap and the interior flaps, comprising the step of sliding the holder from between and around the flaps by moving the holder in a single direction essentially perpendicular to the bottom wall without damaging the holder or the carton.

The invention also provides for the aligning means to have slots which receive tabs on the carton top to lock the top closed.

While the preferred embodiment was designed particularly with the problems of produce cartons in mind, the invention is also useful for record storage cartons and other applications where strengthening is required for stacking.

DESCRIPTION OF THE DRAWINGS

These and other features in the invention will now be described with reference to drawings of a preferred embodiment which is intended to illustrate, and not to limit, the invention, and in which:

FIG. 5 is a perspective view of the preferred embodiment of the corrugated paper portion of a reinforced carton;

FIG. 6 is a perspective view illustrating the bracket of FIG. 1 partially inserted over the end flap of the carton of FIG. 5;

FIG. 7 is a perspective view illustrating the bracket of FIG. 1 partially on the end flap, which has been rotated so as to be adjacent the interior flaps;

FIG. 8 is a partial perspective view illustrating a portion of the assembled reinforced carton;

FIG. 9 is a partial elevational view illustrating a stack of reinforced cartons utilizing the strengthening bracket;

FIG. 10 is a enlarged partial sectional view taken along 10—10 of FIG. 9 illustrating the use of the interconnecting notches and inserts utilized by the carton;

FIG. 11 is a sectional view of a mold utilized to form the bracket of FIG. 1;

FIG. 12 is a perspective view of the bracket used with a carton having a top;

FIG. 13 is a perspective view of a modified form of carton top;

FIG. 20 is an elevation view of a bracket of the present invention having a single strut;

FIG. 21 is an elevation view of a bracket of the present invention having two struts;

FIG. 22 is a partial perspective view illustrating an alternative torque-resisting extension;

FIG. 23 is a partial elevation view of the torque-resisting extension of FIG. 22; and FIG. 24 is a partial perspective view of an alternative embodiment of an indexing tab of the present invention.

DESCRIPTION OF THE PREFERRED EMBODIMENT

Figure 1:
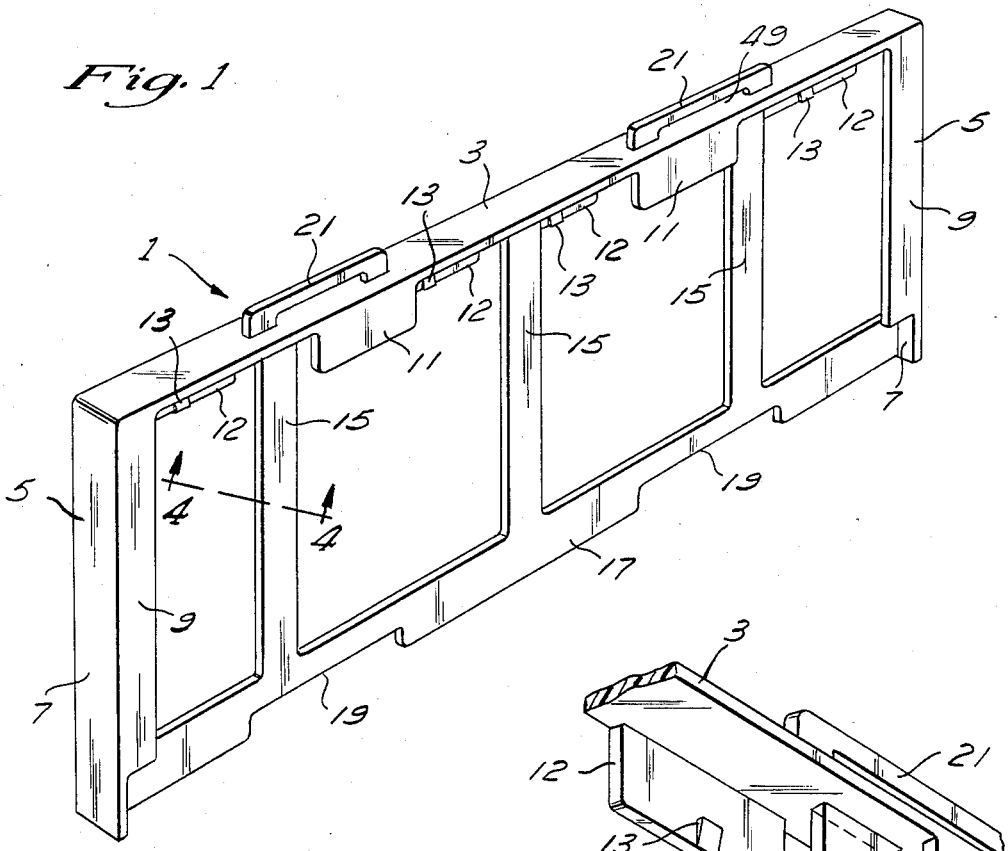
FIG. 1 is a perspective view of the strengthening bracket of the present invention.

Referring to FIG. 1, the carton strengthening bracket 1 includes a top flange 3 and two side flanges 7 joined to form three sides of a rectangle. The rectangle is completed by an elongate connector 17 joined between the bottoms of the side flanges 7. Further stiffening is added to the bracket by a pair of outer end flanges 9, each joined along one edge of a respective side flange 7 to form an angular support member 5. The outer end flanges 9 preferably extend along most of the length of the side flanges 7, but end a substantial distance above the bottom of the side flanges preferably terminating opposite the top of the bottom connector 17. An internal series of spaced struts 15 join the top flange 3 and the bottom connector 17.

Figure 4:
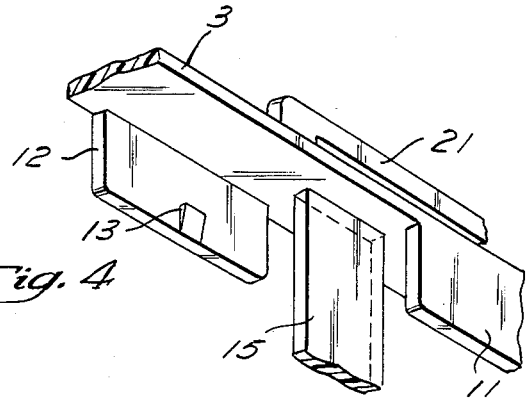
FIG. 4 is an enlarged partial perspective view taken along 4—4 of FIG. 1 illustrating the bracket's flap retainers.

A pair of outer retainers 11 depend from the outer edge of the top flange 3 at spaced locations along its length and four similar inner retainers 12 depend from the inner edge of the top flange 3. As may be seen in greater detail in FIG. 4, each retainer, 11 and 12, preferably incorporates, along its interior surface, a small raised wedge 13 which ensures that the flaps of the carton are firmly gripped.

A pair of inverted U-shaped indexing tabs 21 project from the top flange 3. A pair of notches 19 are formed in the bottom connector 17 directly below the indexing tab 21.

All of the elements described thus far are formed of relatively thin, lightweight material, preferably plastic.

Figure 3:
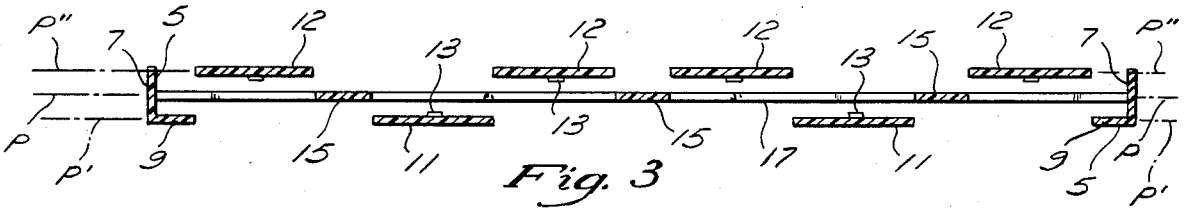
FIG. 3 is a sectional view taken along 3—3 of FIG. 2.

Referring to FIG. 3 as well as to FIG. 1, it will be seen that the bottom connector 17 and the struts 15 are generally in a single plane P, that the outer retainers 11 and the outer end flanges 9 are in a parallel plane P′ spaced outwardly from the plane P and that the inner retainers are in a third parallel plane P″ spaced inwardly from the plane P. The top flange 3 and the side flanges 7 are generally perpendicular to the plane P. The top flange 3 extends from the plane P′ to the plane P″. The side flanges 7 also extend from the plane P′ preferably to the plane P″.

Referring now to FIG. 5, there is shown a carton 23 adapted to be used with the bracket 1.

The carton 23 incorporates a bottom wall 25, a pair of end flaps 27, a pair of side walls 29, and a set of two interior flaps 31 at either end. Additionally, the side walls 29 incorporate a trapezoidal brace 33 which strengthens the wall. Preferably, the brace 33 is formed by making two cuts of equal length in the side walls 29 of the carton, folding the portion between the cuts into the carton and affixing it against the side walls 29 thereof by adhesives or other suitable means.

The operation of the strengthening, flap-holding bracket in conjunction with such a carton will now be described. Starting with a flattened carton, the side walls 29 of the corrugated paper carton 23 are folded so as to be perpendicular to the bottom wall 25, as shown in FIG. 5. The two interior flaps 31 are then folded inward so that they form a 90° angle with the side walls 29, as shown in FIG. 6.

Since the outer end flanges 9 do not extend to the bottom of bracket, the bottom connector 17 is exposed and can be easily positioned over the end flap 27, which is still horizontal, so that the connector 17 rests upon the end flap 27, and the longer side flanges 7 align the bracket 1 with the sides of the end flap 27. The bracket is then slid parallel to the end flap 27 to about the position shown in FIG. 6, so that the end flap 27 is guided between the connector 17 and struts 15 on the inner face, the outer end flanges 9 on the outer face, and the side flanges 7 on the flap edges.

With the end flap 27 thus held by the bracket, the bracket 1 and the end flap 27 are rotated to a position essentially perpendicular to the bottom wall 25 adjacent the internal flaps 31, as shown in FIG. 7. The bracket 1 is then moved further in a direction parallel t the end flap so that the members 5 extend virtually the height of the carton 23, substantially enclosing its upper corners while abutting both side walls 29 and the end flap 27 as shown in FIG. 8. This movement causes the retainers 11 to engage the exterior surface of the end flap 27 and the interior surfaces of the interior flaps 31 and hold them in place. The raised wedges 13 along the interior surface of the retainers 11 ensure that the end flap 27 and the interior flap 31 are held firmly against the struts 15, and that the connector 17 is held firmly between them.

The spacing between the planes P, P′ and P″ is dimensioned to slideably receive the flaps of the carton. The length of the top flange 3 and bottom connector 17 is dimensioned so that the side flanges 5 will abut the sides 29 of the carton. The length of the support members 5 and struts 15 is dimensioned so that when the bottom connector 17 rests on the carton bottom, the top flange rests on the upper edge of the carton end flaps. The retainer tabs 11 and 12 are just long enough to hold the flaps closed and are spaced along the length of the flange 3 so as to best accomplish this.

Once properly assembled, the strengthening bracket is held in place by the force of friction between the flaps and the retainers 11, the flaps and the struts 15, the flaps and the connector 17 and the friction of the support members 5 against the side walls 29 and end flap 27. Because the bracket is a single piece with the struts 15 extending substantially the height of the end flap 27 between the end flap 27 and the interior flaps 31, and the angular members 5 extending substantially the height of the end flap 27 outside of the flaps, inadvertent disassembly of the carton through the bumping or knocking of the carton should not occur.

On the other hand, although the preferred embodiment of the bracket incorporates raised wedges 13 on the flaps 11, the wedges 13 have a taper of only about 7° and therefore permit the retainers 11 to be removed from the flaps, 27 and 31, without damaging those flaps or the retainers 11 themselves. This, and the unique design of the bracket, allows the bracket to be easily, manually removed from the carton by gripping the bracket and sliding the bracket from the carton in a single direction essentially perpendicular to the bottom wall 25. Thus disassembled, the corrugated paper portion of the carton 23 can be discarded and the relatively light and compact strengthening bracket 1 can be retained in order to be used for the assembly of future cartons.

Advantageously, the U-shaped inserts 21 which project from the flange 3 are used for aligning the cartons in a stack. As shown in FIG. 9, these inserts 21 extend through a pair of notches 35 in the carton 23 and fit within the notches 19 in the connector 17. This simple means of alignment guarantees that the cartons will be properly aligned in their stacks and prevents the cartons from sliding relative one another.

The weight of the produce in each individual carton of the stack is transmitted by its corrugated bottom wall to the top flange 3 of the lower carton. The flange then transmits this load to the members 5, so that the weight of the stack is essentially supported entirely by two continuous load-bearing columns formed by the stacked brackets. In order to cushion the shock of the vibration of the vehicle transporting the produce, the members preferably terminate at the bottom wall of the carton so that the load actually is transmitted through the bottom wall of the carton to the top flange below.

The strengthened corrugated carton provides a strong, simple, light weight container particularly adapted for the transportation of produce in stacked loads. Even when strengthened carton becomes wet, the upper corners of the carton will be unable to distend outward due to the fact that the angular members 5 are connected by a flange 3. This prevents the cartons being supported by the corners from slipping into the box and destroying the produce. Likewise, since the angular supports extend substantially throughout the height of the carton and each abut one of the side walls and the end flap, and are connected by a flange, the relatively weak end of the carton is prevented from bending or twisting. Finally, as the bracket substantially encloses the upper corners of the carton, and abuts the end flap and side walls perpendicular to the bottom wall, it is virtually impossible for one of the corners of the carton to completely buckle and cause the entire stack of cartons to tumble over.

As shown in FIG. 12, the carton may also include a top comprised, for example, of two top panels 43 each integrally joined with a respective side wall 29 along a score line 45. Each top panel includes a tab 47 at each end. The tabs 47 are inserted within the opening 49 in the respective inverted U-shaped indexing tabs 21, to hold the top panels closed.

FIG. 13 shows a modified form of top comprised of a single panel 51 with tabs 47 similar to the tabs 47 described above with reference to FIG. 12.

Figure 14:
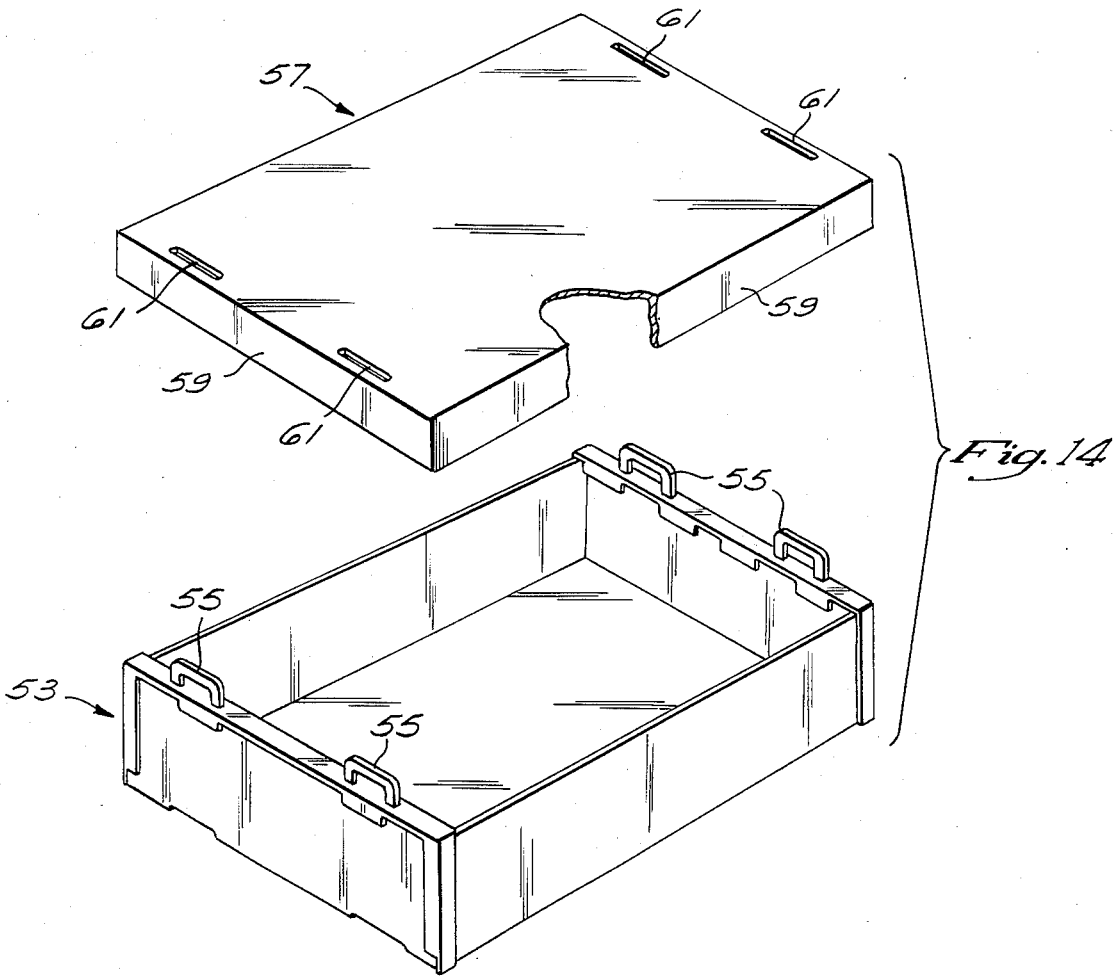
FIG. 14 is an exploded perspective view of a modified bracket and carton top.

FIG. 14 shows a modified bracket 53 having enlarged inverted U-shaped indexing tabs 55. This bracket 53 can be used with a top 57 having side walls 59. The enlarged tabs 55 are adapted to be received by a series of notches 61 in the top 57. The enlarged tabs 55 assure the proper orientation of the top 57 even when the container is somewhat overloaded.

It is clear that the notches 61 may be cut so as to form interior tabs similar to the tabs 47 shown in FIGS. 12 and 13. The insertion of these interior tabs into the slots formed by the raised inverted U-shaped indexing tabs 55 would then lock the top 57 to the carton.

Figure 18:
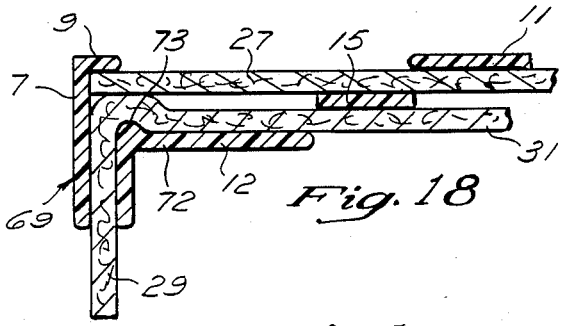
FIG. 18 is a partial sectional view illustrating the assembled form of the bracket of FIG. 15.
Figure 17:
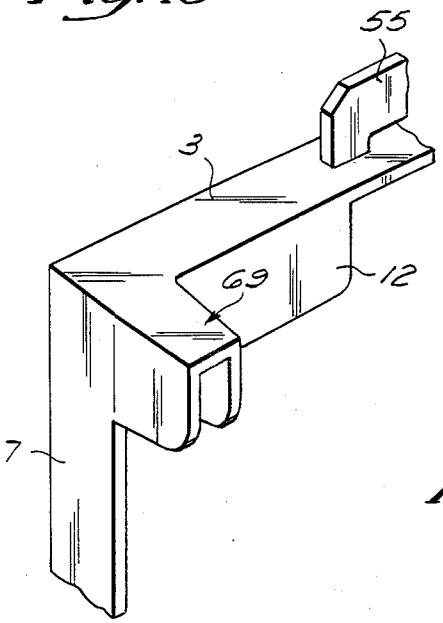
FIG. 17 is a partial perspective view illustrating a torque-resisting extension.

Referring now to FIGS. 15–18, there is shown an alternative embodiment of the invention for use with heavy loads Each end of the bracket 63 is provided with an inverted U-shaped, torque-resisting extension 69. Preferably, the extension 69 is integrally formed with the bracket so that the side flange 7 is coplanar with one side of the extension 69, the top flange 3 is coplanar with the extension top and an inner retainer 12 is integrally joined to the second side of the extension 69. As best seen in FIG. 18, the torque-resisting extension abuts both the interior and exterior surfaces of the carton side wall 29, thus resisting any tendency of the carton side wall 29 to twist relative to the interior flap 31 or the end flap 27.

Figure 16:
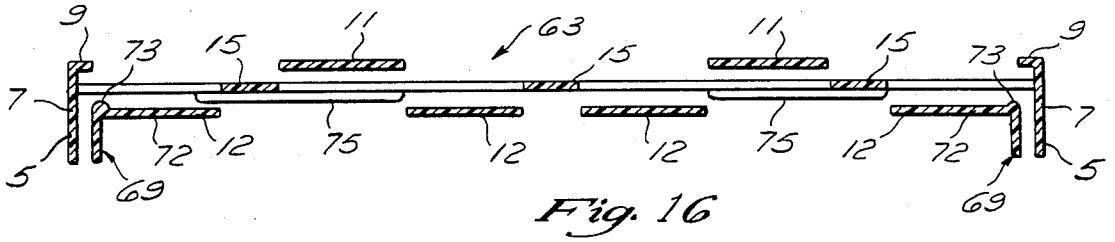
FIG. 16 is a sectional view taken along 16—16 of FIG. 15.

As best seen in FIGS. 16 and 18, the end-most interior retainers 72 may be provided with a raised rib 73 which preferably extends vertically for substantially the entire height of the retainer 72. The rib is adapted to engage the corner formed between the side wall 29 and the interior flap 31 to pinch the interior flap 31 against the end flap 27 to prevent tension on the side walls from pulling the interior flaps from between the struts 15 and the inner retainers 12. This prevents the upper portions of the brackets from distending outward.

Figure 19:
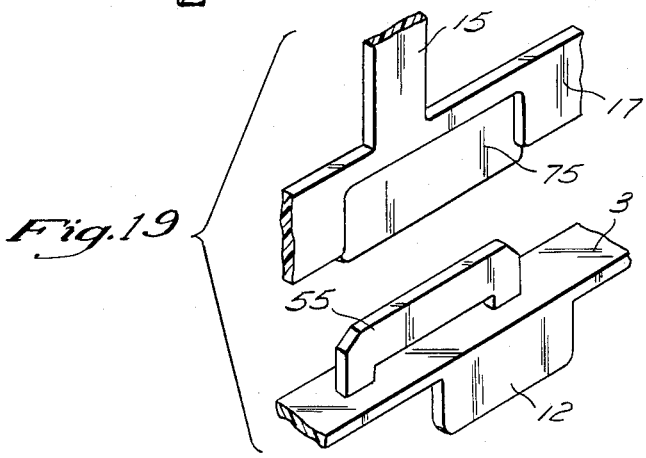
FIG. 19 is a partial perspective view illustrating the mating of the recess and tab of the embodiment of FIG. 15.

The bracket's bottom connector 17 may be provided with a pair of raised projections 75 on one side and a matching pair of recesses 77 on the other. The projections 75 are adapted to be received by a pair of mating notches in the interior flaps 31 of a corrugated carton, similar to notches 35 shown in FIG. 7, to effectively lock the bracket in place. As shown in FIG. 19, the matching recesses 77 are shaped to receive and secure the indexing tabs 55 of a mating bracket against lateral movement.

FIGS. 22 and 23 illustrate an alternative torque-resisting extension 71 adapted for use on cartons having shorter sides than ends. The placement of the extension 71 along the height of the side flange 7 is selected depending upon the height of the carton side, relative to the carton end. One wall of the extension 71 is preferably coplanar with by the side flange 7. Additionally, the top of the extension 71 is preferably integrally joined to an inner retainer 12 in order to prevent the extension 71 from twisting relative the side flange 7.

Figure 15:
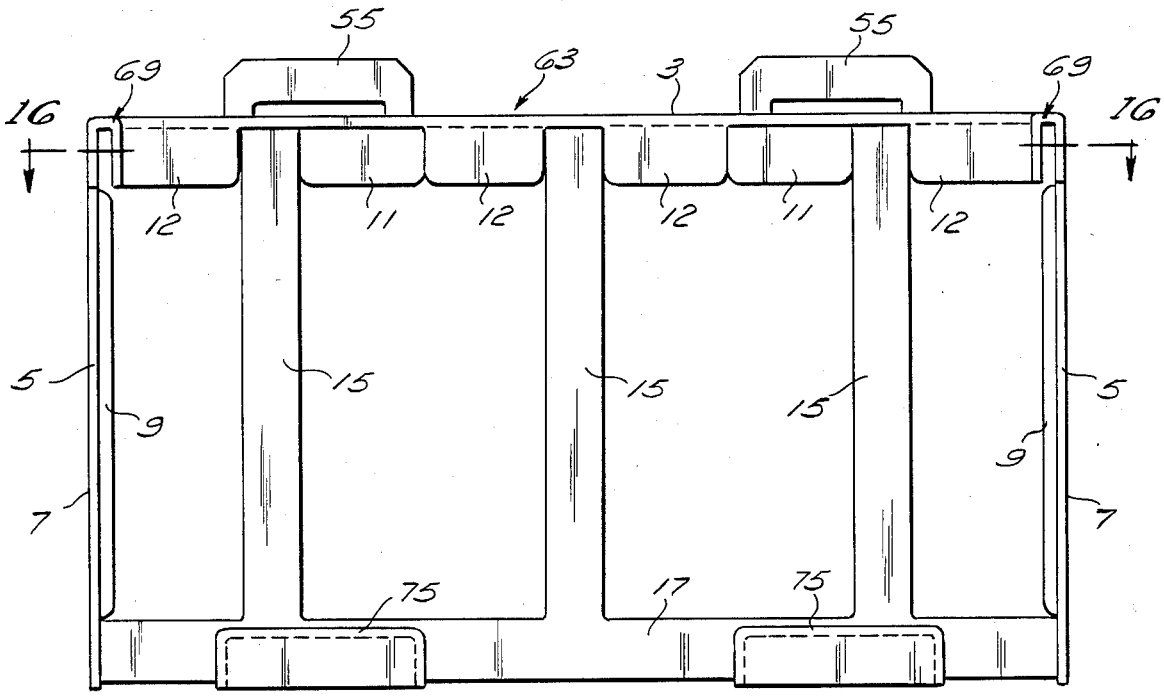
FIG. 15 is an elevation view of an alternative embodiment of the bracket of the present invention.

As best seen in FIGS. 15 and 23, in both embodiments of the extension, the outer end flanges 9 preferably extend from just above the connector 17 to a point just below the lower portion of the torque-resisting extension. This configuration gives the members 5 the greatest strength without creating any overlap of elements in a direction parallel to the side walls of the carton.

As can be appreciated, the design of the present invention readily permits the strength of the bracket to be adjusted by varying the thickness of the material used in the bracket's construction. Additionally, the weight and strength of the bracket can be varied by changing the number of struts 15 utilized in the bracket design. As FIGS. 15, 20 and 21 illustrate, the bracket of the present invention is readily adaptable to use with a wide number of struts. FIG. 15 shows a bracket 63 incorporating three struts 15, while FIGS. 20 and 21 illustrate a single-strut bracket 65 and a double-strut bracket 67, respectively. It is desirable, to utilize only as many struts as are necessary to give the bracket the strength to support the intended load. The fewer struts used, the lighter the bracket and the lower the material cost of each bracket. When transporting extremely light loads, it is, of course, possible to utilize a bracket incorporating no struts at all.

It is clear that the form of the tabs shown is merely illustrative, as a wide variety of indexing tabs may be used in accordance with the principles of the present invention. For example, FIG. 24 illustrates a generally T-shaped tab 79 adapted for use to lock a lid on a carton. The carton lid is advantageously provided with slots slightly larger than the upper surface 81 of the tab 79 and slightly smaller than the overall length of the tab 79. Cam surfaces 83 at either end of the upper surface 81 cause the edges of the slots to flex outwardly momentarily so that the lid is able to slide over the tab 79. The slots then spring back to their original size so that the lid is locked beneath the tab's retaining shoulders 85.

The bracket is designed to minimize the weight, bulk and cost of the strengthened cartons. The design of the bracket is particularly adapted to be molded from light weight plastic, so that the additional weight of the cartons due to the incorporation of the brackets is relatively insignificant. Since the outer edges of the bracket closely follow the outer edges of the corrugated carton, the strengthened container incorporates essentially the same volume as the unstrengthened carton. Furthermore, the strengthened carton is particularly adapted for mass production and therefore should be relatively inexpensive.

The bracket can be utilized in conjunction with corrugated cartons of exceedingly simple design, thus minimizing the time, cost and difficulty involved in manufacturing the body of the carton. Since the bracket advantageously incorporates flap holders, the corrugated cartons can be shipped in a flat condition and be assembled with just the two brackets. Furthermore, due to its light weight and compact design, the bracket is relatively easy for a manufacturer to handle and store.

Figure 2:
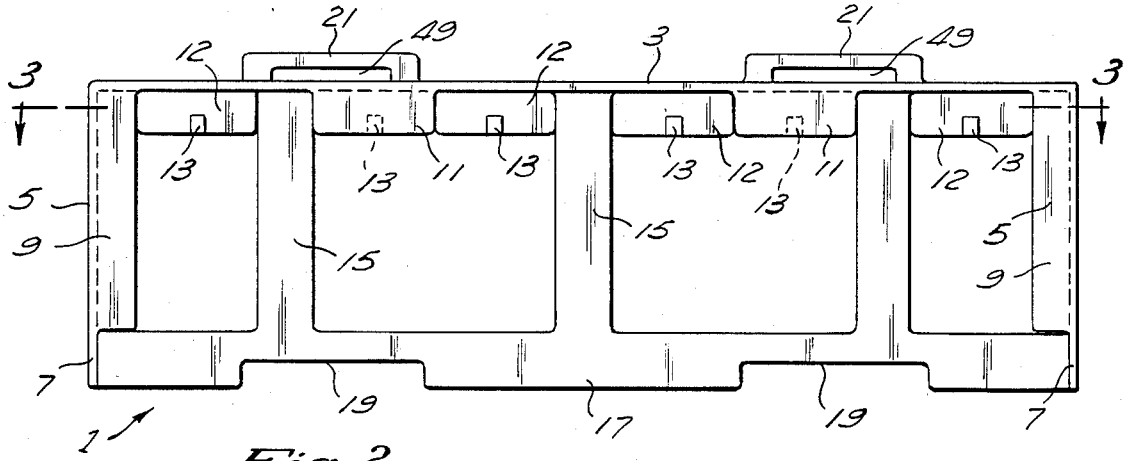
FIG. 2 is a front elevation view of the bracket of FIG. 1.

The unique design of the bracket lends itself to forming by simple injection molding from the sides. As can be seen from FIGS. 2 and 3, neither the flange 3, the side flanges 7, the outer end flanges 9, nor the tabs 11 overlap one another when viewed in a direction parallel to the side wall of the carton. This permits the use of an injection mold having only two pieces 37 and 39, as shown in FIG. 11, to manufacture the bracket. The mold is movable on a single axis 41 and the plastic is injected along an axis parallel to the axis of movement. The use of the basic two-piece mold minimizes the difficulties inherent in the use of more complex mold designs. Furthermore, the method of injection minimizes the difficulties involved in ensuring that the pressure of the plastic is sufficient to completely fill the mold, even during the manufacture of strengthening brackets for use with large cartons.

Finally, due to the bracket's unique design, the mechanized insertion of the strengthening bracket into the carton is greatly facilitated. After the sides and interior flaps of the carton are folded by means well known in the art, the connector is laid over the end flaps so that the connector rests upon it. When the bracket is then slid over the end flap, the connector and the struts will guide the end flap between struts and the angular supports. Thus started, the holder and the end flap can be rotated until the connector and the internal struts abut the internal flaps in a position essentially perpendicular to the bottom panel. The bracket can then simply be pushed in a direction parallel to the end flap so that the retainers hold the interior flaps and the end flap against the struts.

Thus, the carton and bracket can easily be assembled by hand, in a plant or in the field, by semiautomatic machinery, or by completely automatic machinery.

What is claimed is:

1. A bracket for strengthening a carton which has a bottom wall, side walls, and at least one end having an end flap and interior flaps, for holding said flaps and for supporting additional cartons in a stack of cartons, comprising:

a stiffening flange extending parallel to said bottom wall;

a pair of side members extending perpendicularly to said stiffening flange substantially throughout the heighth of said carton to resist the bending and twisting of said carton;

an end flange formed on each of said pair of side members extending parallel to said stiffening flange for engaging said end flap;

a flap retainer depending perpendicular from said stiffening flange for engaging said interior flaps; and an internal member depending from said stiffening flange and extending a significant portion of the heighth of said side members;

said end flanges and said flap retainer being spaced on opposite sides of said internal member to frictionally engage and hold said end flap and said interior flaps against said internal member.

2. The bracket of claim 1 wherein each of said pair of side members are positioned to substantially enclose one of the corners of said carton and to abut one of said side walls and said end flaps.

3. The bracket of claim 2 further comprising an end flap retainer depending from said stiffening flange in a plane substantially parallel to the plane of said end flanges to frictionally engage and hold said end flap against said internal member.

4. The bracket of claim 3 wherein said flap retainer comprises a series of flap retainers extending along the length of said stiffening flange.

5. The bracket of claim 4 wherein said end flap retainer comprises a series of end flap retainers extending along the length of said stiffening flange.

6. The bracket of claim 1 further comprising a connector at the base of said internal member which joins said side members.

7. The bracket of claim 6 wherein said internal member comprises a single strut.

8. The bracket of claim 6 wherein said internal member comprises two struts.

9. The bracket of claim 6 wherein said internal member comprises plural struts.

10. The bracket of claim 6 additionally comprising a recess formed in said connector for receiving a tab of a mating bracket to hold said bracket and said mating bracket in alignment.

11. The bracket of claim 59 additionally comprising a projection formed in said connector adapted to be received by a mating notch formed in one of said interior flaps to lock said bracket to said carton.

12. The bracket of claim 1 additionally comprising means for aligning at least; one of said additional cartons with said bracket.

13. The bracket of claim 12 wherein said aligning means includes a notch for receiving a tab from a top of said container to lock said top closed.

14. The bracket of claim 12 wherein said aligning means includes a generally T-shaped tab for locking a container top closed.

15. A method of inserting a bracket in a carton which has a bottom wall, side walls, and at least one end having an end flap and interior flaps to strengthen said carton, comprising:

partially inserting said bracket over said end flap when said end flap is remote from said interior flaps to capture the side edges of said end flap between a pair of end flanges formed on said bracket;

moving said bracket and said end flap to a position essentially perpendicular to said bottom wall and adjacent said interior flaps to dispose an interior portion of said bracket between said end flap and said interior flaps; and sliding said bracket relative to said end flaps and said interior flaps in a direction parallel to said end flap to engage said end flaps and interior flaps with flap retainers formed on said bracket and disposed on opposite sides of said interior portion of said bracket to hold said end flap and said interior flaps against said interior portion of said bracket.

16. The method of claim 15 wherein said sliding step further comprises the step of engaging a tab formed on said bracket into a complimentary-shaped aperture formed in at least one of said interior flaps to lock said bracket to said carton.

17. A strengthened carton specifically adapted for use in storing produce in refrigerated environments comprising:

a bottom wall having a pair of sides and a pair of ends;

an end flap extending from each of said pair of ends of said bottom wall;

a side wall extending from each of said pair of sides of said bottom wall;

interior flaps extending inward from said side walls; and a pair of brackets disposed adjacent the pair of ends of said bottom wall each of said brackets comprising:

a stiffening flange extending parallel to said bottom wall;

a pair of side members extending perpendicular to said stiffening flange substantially throughout the heighth of said carton to resist the bending and twisting of said carton;

an end flange formed on each of said pair of side members extending parallel to said stiffening flange for engaging said end flap;

a flap retainer depending perpendicularly from said stiffening flange for engaging said interior flaps; and an internal member depending from said stiffening flange and extending a significant portion of heighth of said side members;

said end flanges and said flap retainer being spaced on opposite sides of said internal member to frictionally engage and hold said end flap and said interior flaps against said internal member.

18. The strengthened carton of claim 17 further comprising:

an aperture formed in at least one of said interior flaps on each end of said carton; and formed on the interior portion of said bracket sized to engage said aperture and lock said bracket to said carton.

* * * * *